US008823689B2

(12) United States Patent
Jang et al.

(10) Patent No.: US 8,823,689 B2
(45) Date of Patent: Sep. 2, 2014

(54) DISPLAY DEVICE AND METHOD FOR DRIVING THE SAME

(75) Inventors: Su Hyuk Jang, Daegu (KR); Dong Hoon Cha, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 227 days.

(21) Appl. No.: 13/313,633

(22) Filed: Dec. 7, 2011

(65) Prior Publication Data

US 2012/0147195 A1 Jun. 14, 2012

(30) Foreign Application Priority Data

Dec. 14, 2010 (KR) ..... 10-2010-0127292

(51) Int. Cl.
*G09G 5/00* (2006.01)

(52) U.S. Cl.
USPC ..... 345/204; 345/76; 345/98

(58) Field of Classification Search
USPC ..... 345/204, 76–104
See application file for complete search history.

(56) References Cited

U.S. PATENT DOCUMENTS 6,809,716 B1 * 10/2004 Kim ..... 345/98
2004/0017367 A1 * 1/2004 Kim ..... 345/214
2007/0164969 A1 * 7/2007 Kim ..... 345/99
2008/0129761 A1 * 6/2008 Kim et al. ..... 345/690

FOREIGN PATENT DOCUMENTS

| | | | |
|---|---|---|---|
| CN | 101046941 | A | 10/2007 |
| CN | 101577080 | A | 11/2009 |
| KR | 10-2004-0053428 | A | 6/2004 |
| KR | 10-2005-0071959 | A | 7/2005 |
| KR | 1020060037754 | A | 5/2006 |
| KR | 10-0599607 | B1 | 7/2006 |
| KR | 10-0920373 | B1 | 9/2009 |

* cited by examiner

*Primary Examiner* — Jimmy H Nguyen
(74) *Attorney, Agent, or Firm* — McKenna Long & Aldridge LLP

(57) ABSTRACT

Disclosed is a display device which facilitates to prevent an abnormal display during a driving mode conversion, an abnormal signal input, and a no-signal input, and a method for driving the same, wherein the display device comprises a video controller for detecting an abnormal signal input and no-signal input by monitoring video data and control signals inputted from the external; and generating video data and control signals according to the abnormal signal input and no-signal input so as to enable a normal end of a frame; a timing controller for arranging and outputting the video data, supplied from the video controller, for every frame unit; and generating and outputting control signals for controlling a gate driver and a data driver by the use of timing synchronous signals; and a display panel for displaying image by the use of input video data.

12 Claims, 7 Drawing Sheets

DISPLAY DEVICE AND METHOD FOR DRIVING THE SAME

CROSS REFERENCE TO RELATED APPLICATIONS

This application claims the benefit of the Korean Patent Application No. 10-2010-0127292 filed on Dec. 14, 2010, which is hereby incorporated by reference as if fully set forth herein.

BACKGROUND OF THE INVENTION

1. Field of the Invention

The present invention relates to a display device, and more particularly, a display device which facilitates to prevent an abnormal display during a driving mode conversion, an abnormal signal input, and a no-signal input, and a method for driving the same.

2. Discussion of the Related Art

According to a development in various mobile electronic equipments such as mobile terminal and notebook computer, there is the increasing demand for an applicable flat panel display device.

The flat panel display device may include a liquid crystal display device (LCD), a plasma display panel (PDP), a field emission display device (FED), an organic light-emitting diode display device (OLED), and etc.

Recently, a user is highly interested in OLED owing to various advantages. For example, the OLED emits light in itself without using an additional light source, and the OLED has great brightness, good contrast ratio, wide viewing angle, and rapid response speed.

Depending on a driving method, the OLED may be largely classified into a passive matrix type and an active matrix type.

In case of the passive matrix type, pixels are arranged in a matrix configuration without an additional thin film transistor (hereinafter, referred to as 'TFT'). The respective pixels are sequentially driven according to sequentially-driven scanning lines. Thus, the increased number of lines requires higher voltage supply and instantaneous current application, whereby power consumption is increased, and resolution is limited.

In case of the active matrix type, pixels are arranged in a matrix configuration, and TFTs are respectively formed in the pixels. The respective pixels are driven by switching the TFT and charging a voltage of a storage capacitor (Cst). In comparison to the passive matrix type, the active matrix type has relatively-low power consumption and relatively-high resolution. Thus, the active matrix type OLED is suitable for the display device requiring high resolution and large-sized screen.

Hereinafter, the active matrix type OLED will be briefly referred to as the OLED. Among the various flat display devices, the OLED will be explained in comparison to the LCD device.

The LCD device according to the related art displays an image by controlling light transmittance pixel-by-pixel depending on an input video signal. For this, the LCD device comprises a liquid crystal panel with plural pixels (liquid crystal cells) arranged in a matrix configuration; a backlight unit for supplying light to the liquid crystal panel; and a driving circuit for driving the liquid crystal panel and the backlight unit.

The LCD device according to the related art sequentially supplies input video to the liquid crystal panel line-by-line, and supplies light emitted from a light source to the liquid crystal panel, thereby displaying image.

A pixel voltage is made by a common voltage and a data voltage supplied to each pixel. Then, transmittance of light emitted from the backlight unit can be controlled by aligning liquid crystal molecules of a liquid crystal layer depending on the pixel voltage, to thereby realize the image.

At this time, a lower polarizing sheet (polarizing plate) is provided at the lower side of the liquid crystal panel, wherein the lower polarizing sheet polarizes the light supplied from the backlight unit. An upper polarizing sheet (polarizing plate) is provided at the upper side of the liquid crystal panel, wherein the upper polarizing sheet polarizes the light emitted from the liquid crystal layer.

FIG. 1 illustrates a mode conversion method of an LCD device according to the related art.

In an LCD device according to the related art, as shown in FIG. 1, a system main power is turned-on so as to drive a normal mode (input image driving mode) for displaying an image on a liquid crystal panel according to input video data.

After that, a low voltage differential signal (LVDS) is generated by reading EEP data from an internal memory, wherein the EEP data is provided for driving the liquid crystal panel and driving circuit.

By the use of input video data from the external, respective pixels of the liquid crystal panel are driven to operate a light source of a backlight unit, to thereby supply the light to the liquid crystal panel.

Through these steps, the normal mode is driven to thereby display the image on the liquid crystal panel.

For the mode conversion of the related art LCD device from the normal mode to a sleep mode (power save mode), it firstly needs to enter a stand-by mode. Then, the light source of the backlight unit is turned-off so as to stop the light supply to the liquid crystal panel.

After that, the video data supply to the liquid crystal panel is stopped following stopping the generation of LVDS, whereby the system main power is turned-off.

Accordingly, the image is not displayed on the liquid crystal panel by the mode conversion from the normal mode to the sleep mode through the above steps.

On the mode conversion from the normal mode to the sleep mode, black video data is supplied to the liquid crystal panel, to thereby display a black image on the liquid crystal panel. Prior to the video data supply to the liquid crystal panel, the driving of the backlight unit is turned-off so as to stop the light emission from the light source, thereby preventing the image from being abnormally displayed for the mode conversion.

In the related art LCD device, the mode conversion from the normal mode to the sleep mode is made by the driving method shown in FIG. 1, and the display conversion is smoothly performed by the mode conversion from the sleep mode to the normal mode.

If the video data is normally inputted for a frame period, the backlight unit is turned-off to stop the light supply to the liquid crystal panel. Thus, even though the abnormal video data is supplied to the liquid crystal panel, the abnormal image is not displayed on the liquid crystal panel. That is, when the abnormal video data is supplied to the liquid crystal panel, the black image is displayed on the liquid crystal panel.

Unlike the LCD device, the OLED can emit light in itself so that the OLED has no backlight unit therein.

In case of the OLED, each pixel is driven according to the video data supplied to a display panel, to thereby display the image. Thus, if there is the mode conversion, the abnormal image may be displayed on the display panel.

FIGS. 2 and 3 illustrate the problem of abnormal display by the mode conversion or abnormal-signal input in the related art OLED.

Referring to FIGS. 2 and 3, an input signal (video data and driving signal) should be monitored so as to make the smooth mode conversion of the system, to thereby prevent the abnormal display for the mode conversion.

In order to prevent the abnormal image display, it is necessary to detect the abnormal signal input and no-signal input, and to process the detected signal.

However, the related art OLED does not show the structure or method capable of preventing the abnormal display for the mode conversion, abnormal signal input, and no-signal input.

Even though the abnormal video data is supplied from the external to the related art OLED, it is not checked whether or not the input data is abnormal, whereby the abnormal video data may be displayed on the display panel.

Even though the abnormal signal is supplied to the display panel 10, or the supply of the video data is stopped for a frame period, it is not checked so that the abnormal display may be shown on the display panel.

On the abnormal signal input or mode conversion, plural gate lines may be turned-on due to errors in gate control signals. Thus, the display panel 10 may be damaged to thereby shorten the lifespan of the display panel 10.

In order to overcome these problems, the video data corresponding to the frame for the mode conversion is not displayed for the mode conversion. If the video data is inputted abnormally, that is, in case of the no-signal input, it needs an additional display mode capable of substituting the no-signal input.

However, in case of the related art OLED, there is no additional display mode handling the problems of mode conversion, abnormal signal input, and no-signal input. Also, the related art OLED does not include the structure and method capable of preventing the abnormal display on the mode conversion or abnormal signal input.

SUMMARY OF THE INVENTION

Accordingly, the present invention is directed to a display device and a method for driving the same that substantially obviates one or more problems due to limitations and disadvantages of the related art.

An aspect of the present invention is to provide a display device and a method for driving the same, which facilitates to prevent an abnormal image from being displayed on a liquid crystal panel for a driving mode conversion.

Another aspect of the present invention is to provide a display device and a method for driving the same, which facilitates to prevent an abnormal image from being displayed on a liquid crystal panel for an abnormal signal input.

Another aspect of the present invention is to provide a display device and a method for driving the same, which facilitates to prevent an abnormal image from being displayed on a liquid crystal panel for a no-signal input.

Another aspect of the present invention is to provide a display device and a method for driving the same, which facilitates to prevent failure of gate control signals for an abnormal signal input or mode conversion.

Another aspect of the present invention is to provide a display device and a method for driving the same, which facilitates to prevent a display panel from being damaged by failure of gate control signals.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a display device comprising: a video controller for detecting an abnormal signal input and no-signal input by monitoring video data and control signals inputted from the external; and generating video data and control signals according to the abnormal signal input and no-signal input so as to enable a normal end of a frame; a timing controller for arranging and outputting the video data, supplied from the video controller, for every frame unit; and generating and outputting control signals for controlling a gate driver and a data driver by the use of timing synchronous signals; and a display panel for displaying image by the use of input video data.

At this time, the video controller generates video data and control signals which substitute for the abnormal signal input and no-signal input in case of a mode conversion from a normal mode to a power save mode; and supplies them to the timing controller.

Also, the video controller comprises: a signal detector for detecting the abnormal signal input and no-signal input by monitoring video data and control signals inputted from the external; a clone signal generator for generating clone video data enable signal (clone DE) and clone video data for forming a frame when a frame is not normally completed by the abnormal signal input; an abnormal signal processor for generating no-signal data enable signal and no-signal video data for forming a frame in case of the no-signal input; and a signal output unit for selectively outputting the clone data enable signal/clone video data or the no-signal data enable signal/no-signal video data to the timing controller.

In yet another aspect of the present invention, there is provided a method for driving a display device comprising: detecting an abnormal signal input and no-signal input by monitoring video data and control signals inputted from the external; converting video data and control signals depending on the abnormal signal input and no-signal input so as to enable a normal end of a frame; and displaying image by the use of video data and control signals converted for the normal end of a frame.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, a display device according to the present invention and a method for driving the same will be described with reference to the accompanying drawings.

Figure 1:
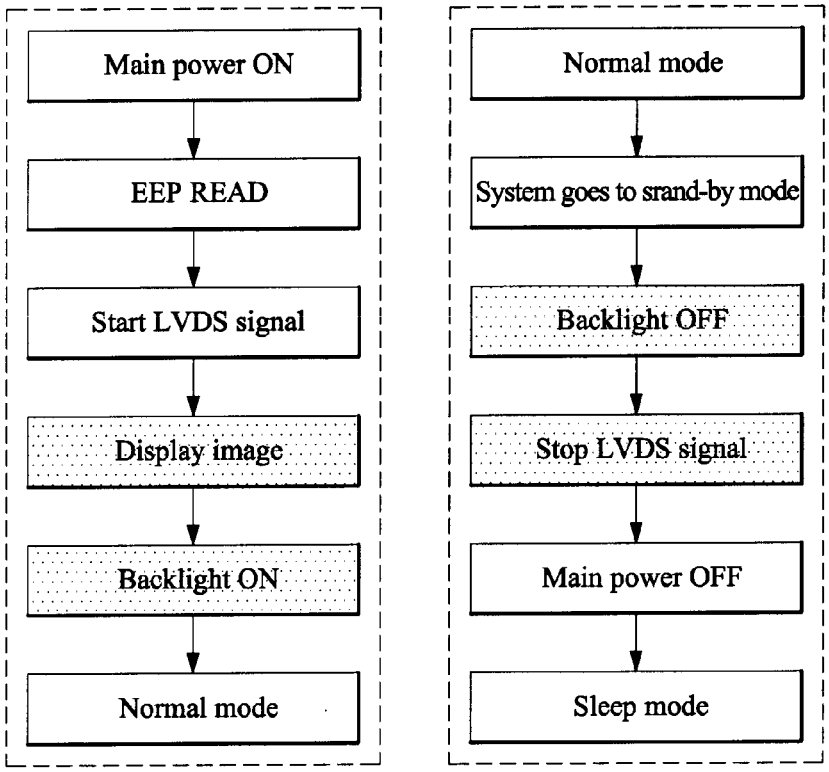
FIG.1 [PRIOR ART]
FIG. 1 illustrates a mode conversion method in a related art LCD device
Figure 2:
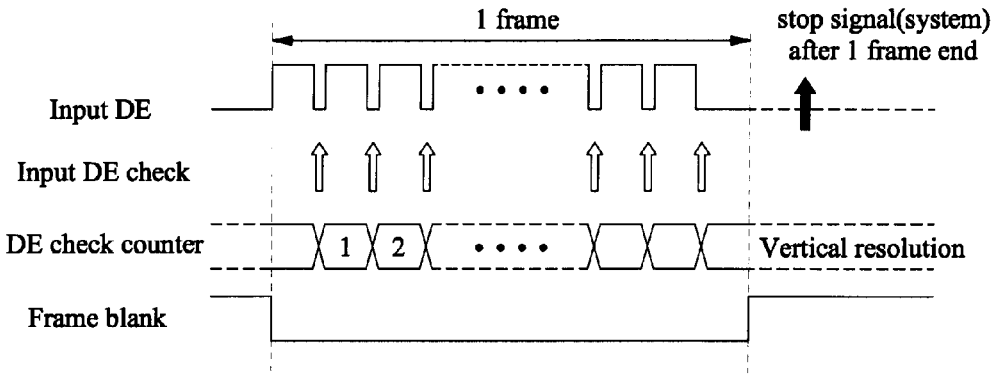
FIG.2 [PRIOR ART]
FIGS. 2 and 3 illustrate a problem of abnormal display by a mode conversion or abnormal-signal input in a related art OLED.
Figure 3:
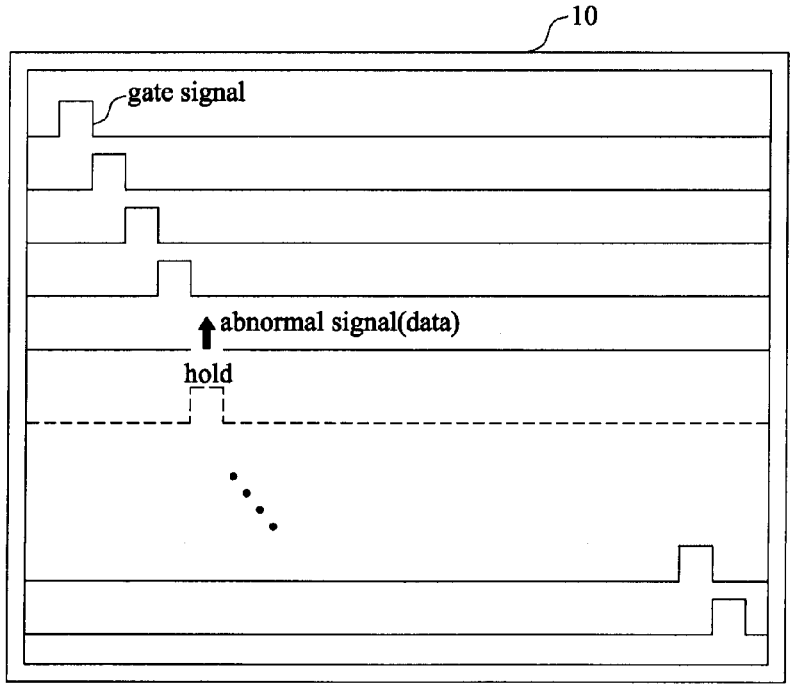
FIG.3 [PRIOR ART]
Figure 4:
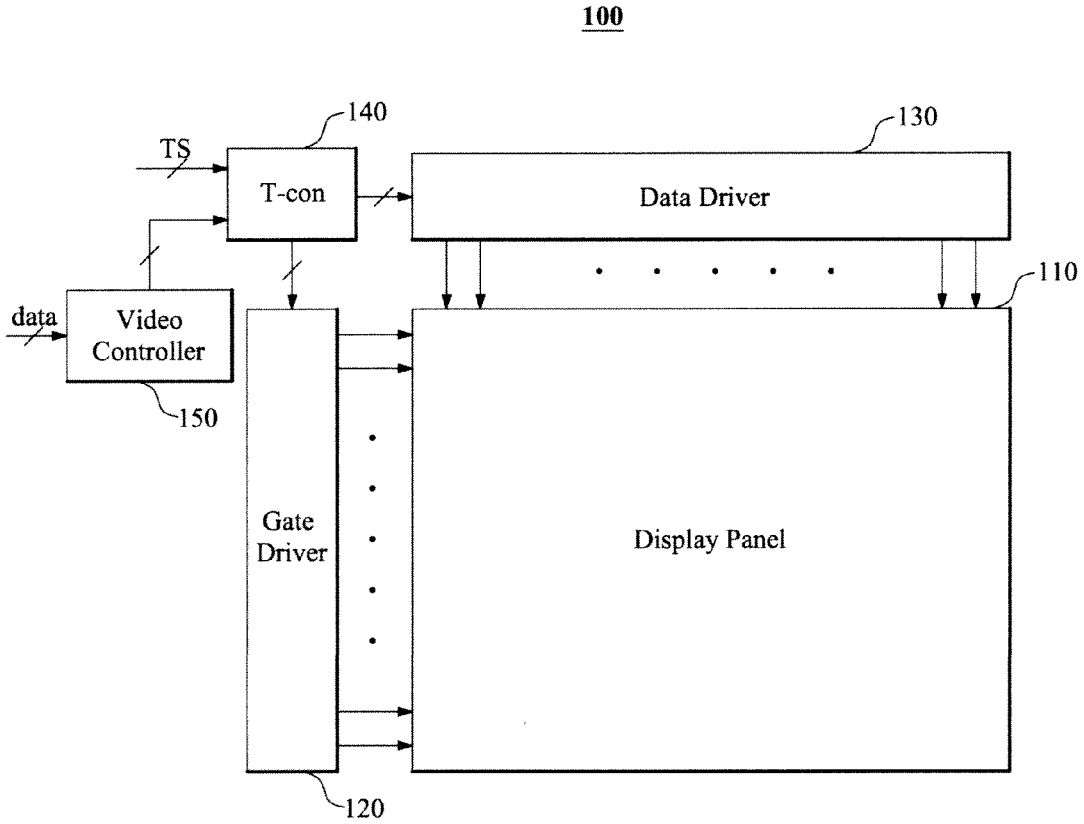
FIG. 4 illustrates a display device according to the embodiment of the present invention.
Figure 5:
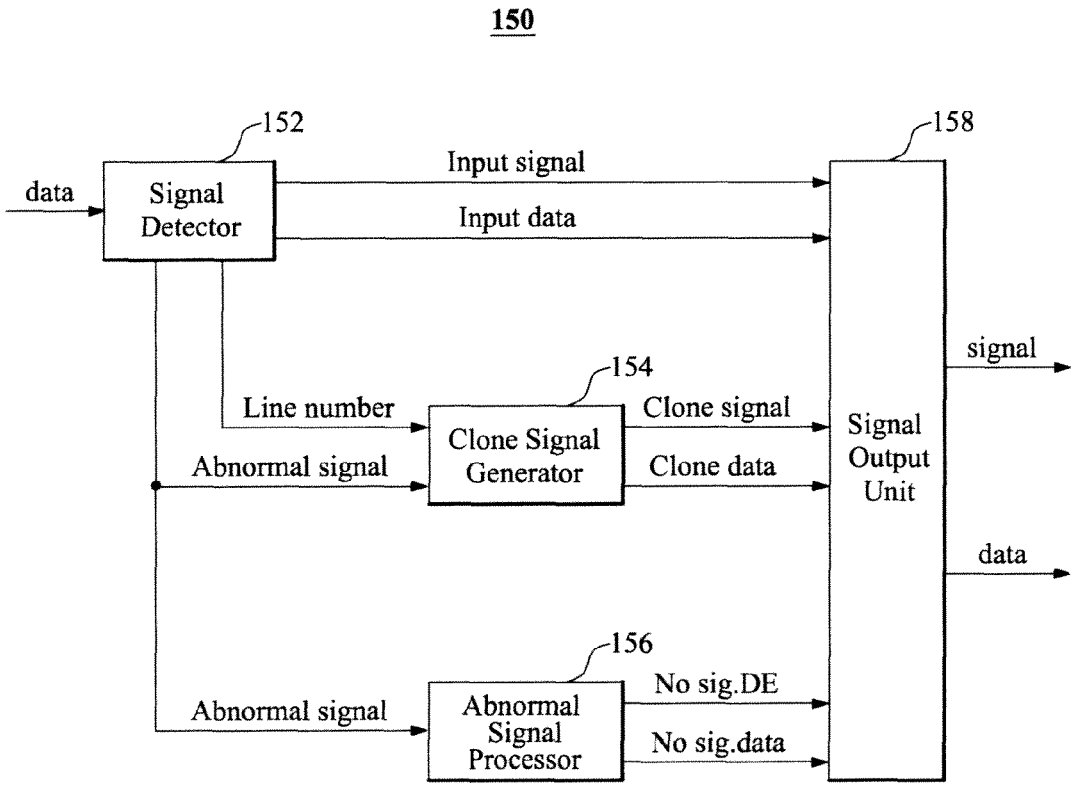
FIG. 5 illustrates an image controller shown in FIG. 4.

FIG. 4 illustrates a display device according to the embodiment of the present invention. FIG. 5 illustrates a video controller in the display device of FIG. 4.

Referring to FIGS. 4 and 5, the display device according to the embodiment of the present invention comprises a display panel 110 for displaying an image; a gate driver 120 for supplying a driving signal to each pixel of the display panel 110; a data driver 130 for supplying video data to the display panel 110; a timing controller 140 for supplying the driving signal to the gate and data drivers 120 and 130, and supplying the video data arranged by a frame unit to the data driver 130; an EL driver (not shown) for supplying a light-emitting signal to each pixel of the display panel 110; a video controller 150 for controlling the driving signal and the image displayed on the display panel 110 depending on a driving mode conversion, an abnormal signal input, or a no-signal input; and a power supplier (not shown) for supplying power of driving the display panel 110.

The display panel 110 includes a plurality of pixels.

As the plurality of pixels are turned-on according to the driving signal supplied from the gate driver 120, the plurality of pixels display the image based on the video data supplied from the data driver 130.

Although not shown, each of the pixels includes a gate line supplied with a scan signal from the gate driver 120; a data line supplied with the video data (data voltage) from the data driver 130; an EL line supplied with the light-emitting signal from the EL driver; a VDD line supplied with the driving power (VDD) from the power supplier; an organic light-emitting diode (OLED) driven to emit light depending on the video data; a plurality of TFTs switched to supply the video data of the OLED; and a capacitor for maintaining the data voltage for a preset period.

The gate and data lines are arranged alternately, and the VDD line and the data lines are arranged in the same direction.

The timing controller 140 generates a timing control signal for driving the display panel 110 by the use of input timing signal (TS), and supplies the generated timing control signal to the gate driver 120, the data driver 130, and the display panel 110.

Also, the timing controller 140 rearranges the video data supplied from the video controller 150 by the frame unit, and supplies the rearranged video data to the data driver 130.

At this time, the timing signal (TS) may include a data enable signal (DE), a horizontal synchronous signal (Hsync), a vertical synchronous signal (Vsync), and a clock signal (CLK).

The timing control signal may include a gate control signal (GCS) for controlling the gate driver 120, and a data control signal (DCS) for controlling the data driver 130.

The generated gate control signal (GCS) is supplied to the gate driver 120, and the generated data control signal (DCS) is supplied to the data driver 130.

The gate control signal (GCS) may include a gate start pulse (GSP), a gate shift clock (GSC), and a gate output enable (GOE).

The data control signal (DCS) may include a source start pulse (SSP), a source sampling clock (SSC), and a source output enable (SOE).

The gate driver 120 generates a scan signal for turning on/off the TFT in each pixel depending on the gate control signal (GCS) supplied from the timing controller 140. The generated scan signal is sequentially supplied to the plurality of gate lines.

The data driver 130 converts the video data supplied from the timing controller 140 into a driving current, and supplies the driving current to each pixel of the display panel 110.

For a smooth system mode conversion, it is necessary to monitor the input signal (video data and driving signal). In order to prevent the abnormal display by the abnormal signal or no-signal input, the abnormal signal and no-signal input should be detected and then processed.

On the mode conversion from a normal mode to a sleep mode (power save mode), the abnormal display is prevented. Also, it is possible to prevent the abnormal display according to the abnormal signal input and the no-signal input.

For example, the video data and control signals are converted for a vertical blank of the video data. For this, the display device 100 according to the embodiment of the present invention includes the video controller 150 as shown in FIG. 5.

Hereinafter, a structure of the video controller 150 and a method for driving the display device 100 according to the embodiment of the present invention will be described with reference to FIGS. 5 to 8.

Referring to FIG. 5, the video controller 150 includes a signal detector 152, a clone signal generator 154, an abnormal signal processor 156, and a signal output unit 158.

The signal detector 152 detects the video data input from the external, and checks that the input video data corresponds to the normal signal, abnormal signal, or no-signal.

If the input video data corresponds to the normal signal, it is transmitted to the signal output unit 158. Then, the signal output unit 158 outputs the video data corresponding to the normal signal, which is checked by the signal detector 152, to the timing controller 140, whereby the image is normally displayed on the display panel 110.

If the input video data corresponds to the abnormal signal which cannot complete a frame, the signal detector 152 supplies a line number of the abnormal signal, and the abnormal signal to the clone signal generator 154.

If the video data is not inputted, that is, no-signal input, the signal detector 152 determines that it is the abnormal signal. Then, the abnormal signal depending on the no-signal input is supplied to the abnormal signal processor 156.

If the normal signal is inputted, the signal detector 152 sets a clone data enable signal (hereinafter, referred to as 'clone DE') as '0', and sets the abnormal signal as '0'. Then, the signal detector 152 supplies the normally-provided 'Input Signal' and 'Input Data' to the signal output unit 158.

If the abnormal signal is inputted, the clone signal generator 154 generates clone video data and clone DE for preventing the abnormal display on the display panel 110. Then, the generated clone DE and clone video data are supplied to the signal output unit 158.

Also, the clone signal generator 154 monitors the signals inputted to the timing controller 140. Based on the monitoring result, if the input signal is the abnormal signal, the clone signal generator 154 generates the clone DE and clone video data, whlercby the abnormal frame is completed.

In more detail, the clone signal generator 154 checks whether or not the frame is abnormally completed by the use of abnormal signal and line number inputted from the signal detector 152.

Figure 6:
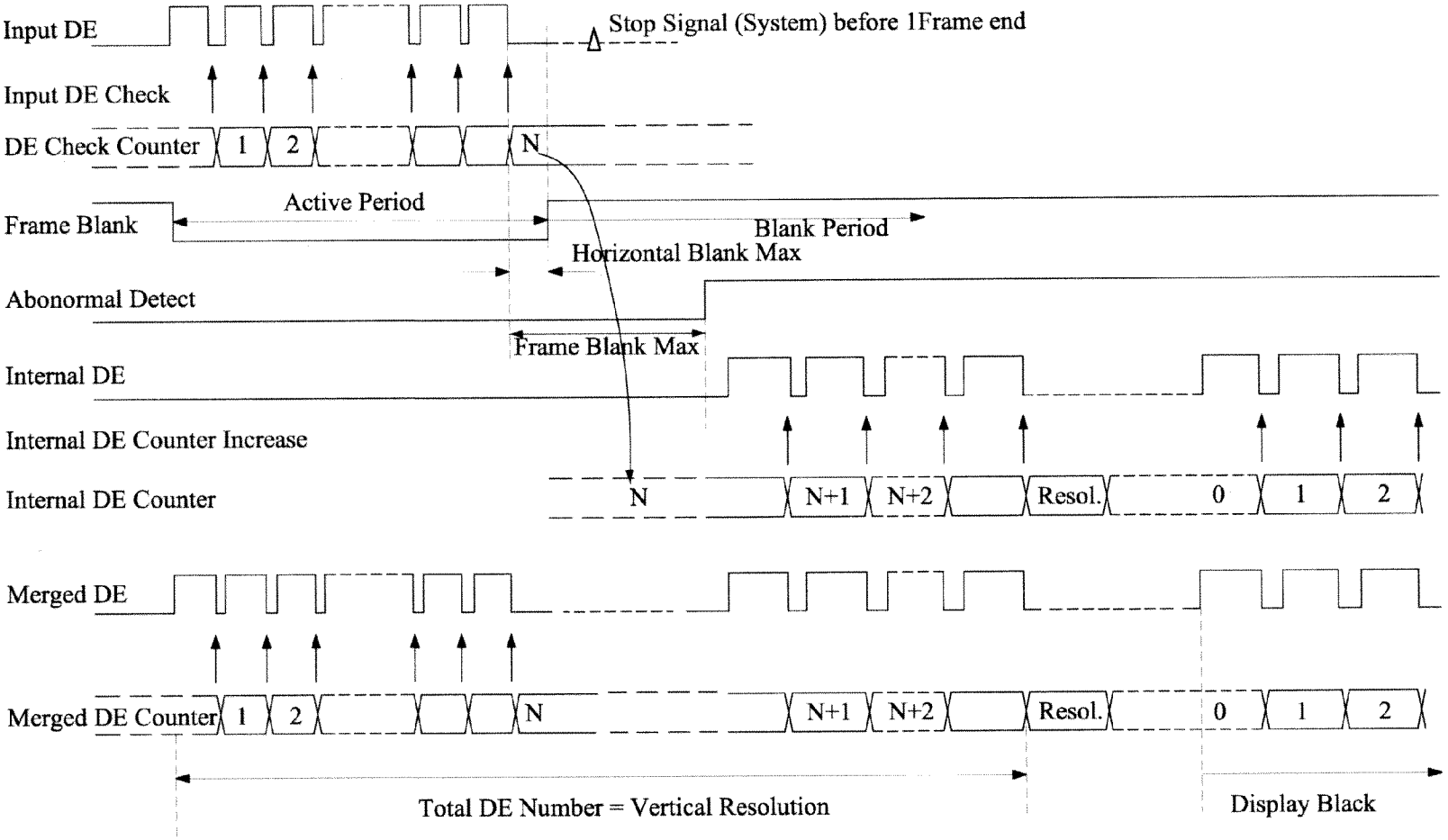
FIGS. 6 to 8 illustrate a method for driving the display device according to the embodiment of the present invention.

For this, as shown in FIG. 6, when input data (input DE) is checked, and the DE signal is not inputted after the input of the (N)th DE signal, the abnormal signal input is sensed.

If the normally-inputted video data and control signals are cut-off abnormally for a frame, the clone signal generator 154 internally generates the clone DE which substitutes for the DE signal inputted from the external, to thereby normally complete a frame. Also, the clone signal generator 154 internally generates the clone video data synchronized with the clone DE.

If the signal input is stopped after the (N)th DE signal, a frame is normally completed by the internally-generated (N)th DE signal, (N+1)th DE signal, and (N+2)th DE signal.

Figure 7:
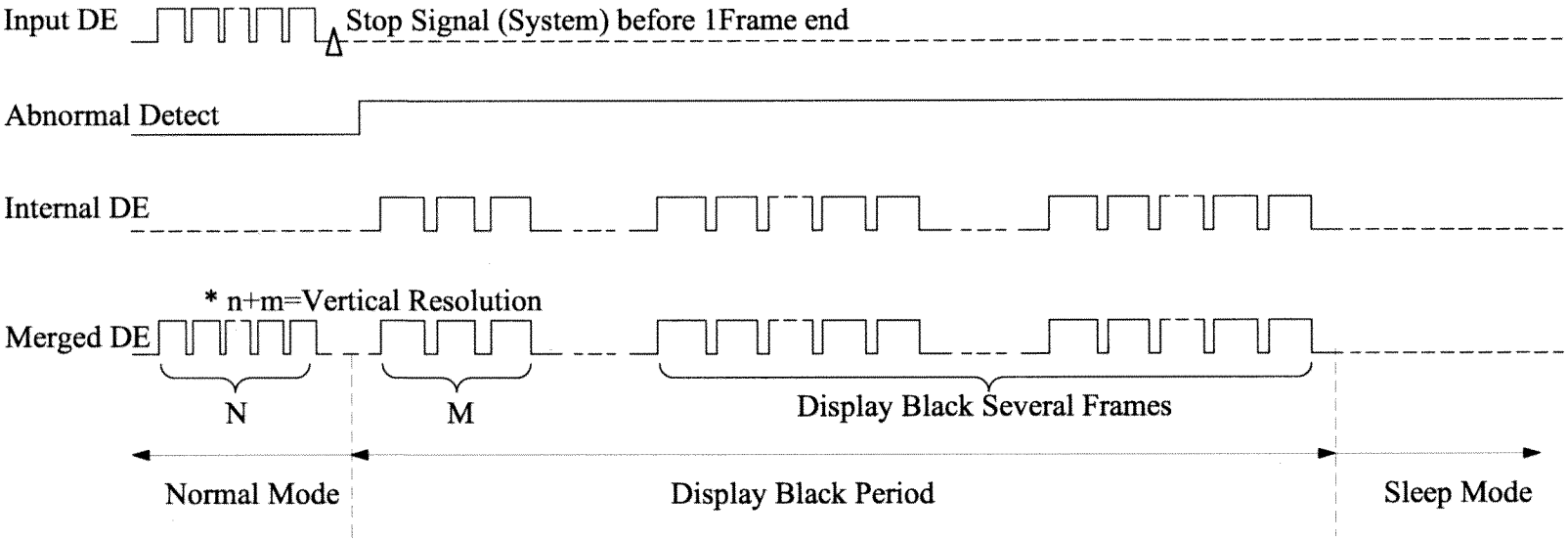

If the clone DE and the clone video data are generated (active), a clone enable signal (clone En) is in a high state. Supposing that all of the clone DE, clone video data and clone En signal are generated. In this case, even though the abnormal signal and abnormal data are inputted from the external, it is possible to normally complete a frame. That is, as shown in FIG. 7, a frame can be normally completed by combining the (N) DE signals inputted from the external with the (M) DE signals generated internally.

For the next frame, the clone DE is internally generated to substitute for the entire DE signal of the next frame. At this time, the clone video data may include black data for displaying black image, or option data optionally set by a user.

Figure 8:
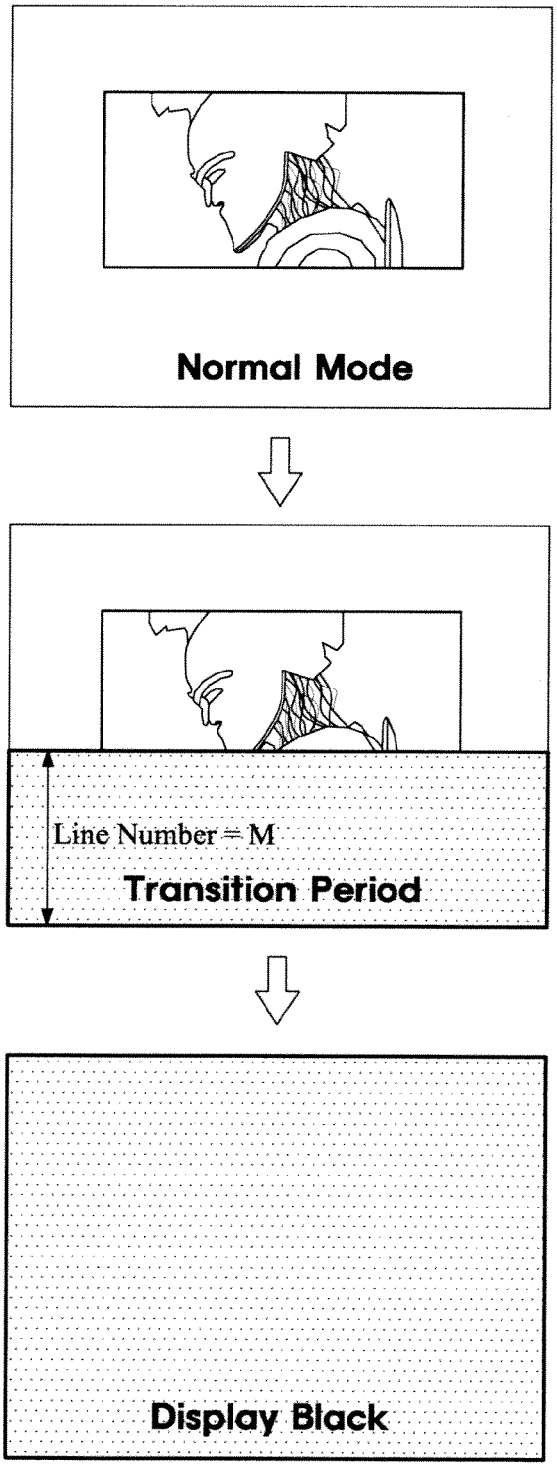

The clone video data of black data which substitutes for the abnormal data for a frame may be generated. In this case, as shown in FIG. 8, a frame may be displayed by combining the normal input data with the black data, to thereby prevent an image distortion by the abnormal signal input. Then, the next frame may be entirely displayed as the black image.

The abnormal signal inputted from the clone signal generator 154 may include no-signal data where the input data and control signals are not inputted, as well as the signal which is not normally filled for a frame.

In case of the abnormal signal input, the clone signal generator 154 sets the clone DE as '1', and sets the abnormal signal as '1'; and then supplies them to the signal output unit 158.

The abnormal signal processor 156 activates the abnormal signal indicating the abnormal signal input or no-signal input on the basis of the abnormal signal inputted from the signal detector 152. Then, the abnormal signal processor 156 generates the data enable signal (No Sig. DE) and video data (No Sig. Data) depending on the no-signal input; and then supplies them to the signal output unit 158.

At this time, the abnormal signal processor 156 generates data enable signal and video data (black or RGB pattern) on the basis of internal VCO clock (or oscillator); and then supplies them to the signal output unit 158.

The signal output unit 158 selects the signal and data supplied from the signal detector 152, the clone signal generator 154, and the abnormal signal processor 156; and then supplies the selected signal and data to the timing controller 140.

In an example, the signal output unit 158 sets the clone DE as '0', and sets the abnormal signal as '0'. In this case, since the input signal corresponds to the normal signal, the signal output unit 158 selects 'Input Signal' and 'Input Data', and outputs the selected them to the timing controller 140, as shown in FIG. 5.

In another example, when a frame is abnormally completed by the abnormal signal input or no-signal input, the clone signal generator 154 generates the clone DE and clone video data. In this case, the signal output unit 158 may supply the clone DE and clone video data generates in the clone signal generator 154 to the signal output unit 158.

If the clone DE is set as '1', and the abnormal signal is set as '1', it indicates that the abnormal signal is inputted. Thus, the clone DE and clone video data is selected and supplied to the timing controller 140.

In another example, if the clone DE is set as '0', and the abnormal signal is set as '1', it indicates that the clone DE is generated by the abnormal signal input. Since the input signal is still abnormal after completion of a frame, 'No Sig. DE' and 'No Sig. Data' are selected and supplied to the timing controller 140.

That is, if the input signal of the second frame is abnormal after the first frame where the abnormal signal is inputted, the video data of the second frame is output while being converted into the black data to display the black image for the second frame.

At this time, the clone DE and clone video data internally generated in the video controller 150 are converted for a frame blank, as shown in FIGS. 6 and 7. That is, if there is no signal input, a frame is complete with the internally generated signals. Meanwhile, if the normal signal is inputted for the driving process, the signal is converted for the frame blank.

The video controller 150 checks that the input signal is abnormally cut-off for a period except the frame blank every frame, and also checks the no-signal input. Also, the scan signal generated in the gate driver 120 is sequentially supplied to the plurality of gate lines for a frame. Then, the shift of the scan signal is ended at a frame end point. If the frame is abnormally ended, the shift of the scan signal is abnormally ended. However, the present invention enables to normally end the shift of the scan signal even though the frame is abnormally ended.

As shown in FIG. 8, even if the system mode conversion is abnormal in the above display device 100 according to the embodiment of the present invention, the display image of a frame is normally ended, thereby preventing the display panel 110 from being damaged by failure of the mode conversion. Also, it is possible to prevent the abnormal image from being displayed on the display panel by the abnormal signal input or no-signal input.

For the above explanation and drawings, the video controller 150 is a separate element inside the display device 100, but not necessarily.

According to another embodiment of the present invention, the video controller 150 may be entirely or partially included in the timing controller 140. For example, the signal output unit 158 may be formed as a logic part of the timing controller 140.

The above explanation exemplary illustrates the OLED device among the display devices. However, the present invention may be applied to the other display devices which emit light in itself to thereby display image.

On the driving mode conversion, the display device of the present invention and the method for driving the same may prevent the abnormal image from being displayed on the display panel 110.

Also, it is possible to prevent the abnormal image from being displayed on the display panel 110 by the abnormal signal input.

Even in case of the no-signal input, it is possible to prevent the abnormal image from being displayed on the display panel 110 in the display device according to the present invention.

In case of the abnormal signal input or mode conversion, it is possible to prevent the display panel from being damaged by failure of gate control signals It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a video controller for detecting an abnormal signal input and no-signal input by monitoring source video data and source control signals input from an external device, and generating substitute video data according to the abnormal signal input so as to enable a normal end of a frame, and generating substitute control signals according to the no-signal input so as to enable a normal end of a frame, wherein the substitute control signals are different from the source control signals and the substitute video data is different from the source video data;

a timing controller for arranging and outputting the substitute video data, supplied from the video controller, and generating and outputting driver control signals for controlling a gate driver and a data driver by the use of the substitute control signals and timing synchronous signals inputted from the external device; and a display panel for displaying image by use of the substitute video data and substitute control signals.

2. The display device according to claim 1, wherein the video controller generates the substitute video data which substitute for the abnormal signal input in case of a mode conversion from a normal mode to a power save mode, wherein the video controller generates the substitute control signals which substitute for the no-signal input in case of a mode conversion from a normal mode to a power save mode, and the video controller supplies the substitute video data and the substitute control signals to the timing controller.

3. The display device according to claim 1, wherein the video controller comprises:

a signal detector for detecting the abnormal signal input and the no-signal input by monitoring the source video data and the source control signals inputted from the external device;

a clone signal generator for generating first substitute data enable signal (clone DE) and first substitute video data for forming a frame when a frame is not normally completed by the abnormal signal input;

an abnormal signal processor for generating second substitute data enable signal and second substitute video data for forming a frame in case of the no-signal input; and a signal output unit for selectively outputting the first substitute data enable signal, the first substitute video data or the second substitute data enable signal, the second substitute video data to the timing controller.

4. The display device according to claim 3, wherein the signal detector supplies a first abnormal signal and a line number of the first abnormal signal to the clone signal generator when a frame cannot be completed, and wherein the signal detector generates a second abnormal signal depending on the no-signal input when the source video data corresponds to the no-signal input.

5. The display device according to claim 4, wherein the video controller checks source data enable signal, and generates the first substitute data enable signal after the (N)th source data enable signal where the input is cut-off, and the first substitute video data synchronized with the first substitute data enable signal.

6. The display device according to claim 5, wherein the video controller constructs the first substitute data enable signal of a frame by combining the normally-inputted 'N' source data enable signal with the internally-generated 'M' first substitute data enable signal; and converts the source video data to be synchronized with the internally-generated 'M' first substitute data enable signal.

7. The display device according to claim 6, wherein the video controller generates the first substitute video data for displaying black image so as to display the black image after displaying a normal image depending on normal video data in a frame.

8. The display device according to claim 4, wherein, if a source video data of a second frame is abnormal after a first frame with the abnormal signal included therein, the video controller converts the source video data of the second frame into black data to display black image.

9. The display device according to claim 4, wherein the video controller generates the second substitute data enable signal and the second substitute video data in a frame blank period.

10. A method for driving a display device comprising:

detecting an abnormal signal input and no-signal input by monitoring source video data and source control signals input from an external device;

generating substitute video data according to the abnormal signal input so as to enable a normal end of a frame, and generating substitute control signals according to the no-signal input so as to enable a normal end of a frame, wherein the substitute control signals are different from the source control signals and the substitute video data is different from the source video data;

displaying image by use of the substitute video data and the substitute control signals for the normal end of a frame.

11. The method according to claim 10, wherein the substitute video data and the substitute control signals are generated in case of a mode conversion from a normal mode to a power save mode.

12. The method according to claim 10, wherein the substitute video data and the substitute control signals comprises:

if a frame is not normally completed by the abnormal signal input, generating first substitute data enable signal and first substitute video data for forming a frame; and in case of no-signal input, generating second substitute data enable signal and second substitute video data for forming a frame.

* * * * *